US008404097B2

(12) United States Patent
Ware et al.

(10) Patent No.: US 8,404,097 B2
(45) Date of Patent: Mar. 26, 2013

(54) PROCESS FOR PLATING A METAL OBJECT WITH A WEAR-RESISTANT COATING AND METHOD OF COATING

(75) Inventors: Michael H. E. Ware, Renton, WA (US); Luong M. Tran, Tacoma, WA (US); James E. Skilton, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1202 days.

(21) Appl. No.: 11/610,984

(22) Filed: Dec. 14, 2006

(65) Prior Publication Data

US 2007/0084731 A1 Apr. 19, 2007

Related U.S. Application Data

(63) Continuation-in-part of application No. 10/772,683, filed on Feb. 4, 2004, now abandoned.

(51) Int. Cl.
*C25D 3/56* (2006.01)

(52) U.S. Cl. ..... 205/258

(58) Field of Classification Search ..... 205/258
See application file for complete search history.

(56) References Cited

U.S. PATENT DOCUMENTS

| | | | | |
|---|---|---|---|---|
| 2,643,221 | A | 6/1953 | Brenner et al. | |
| 3,073,762 | A * | 1/1963 | Koretzky | 205/258 |
| 3,350,773 | A | 11/1967 | Beebe, Jr. et al. | |
| 3,355,267 | A | 11/1967 | Du Rose | |
| 3,857,683 | A * | 12/1974 | Castonguay | 428/608 |
| 4,037,646 | A * | 7/1977 | Hara et al. | 164/418 |
| 4,100,050 | A | 7/1978 | Cook, Jr. et al. | |
| 4,305,792 | A | 12/1981 | Kedward et al. | |
| 4,786,390 | A | 11/1988 | Lichtenberger et al. | |
| 5,240,590 | A | 8/1993 | Brar et al. | |
| 5,316,650 | A * | 5/1994 | Ratzker et al. | 205/67 |
| 6,406,611 | B1 * | 6/2002 | Engelhaupt et al. | 205/259 |
| 7,294,211 | B2 * | 11/2007 | Sturgill et al. | 148/273 |
| 2003/0234063 | A1 * | 12/2003 | Sturgill et al. | 148/273 |

FOREIGN PATENT DOCUMENTS

| | | | |
|---|---|---|---|
| FR | 793946 | * | 2/1936 |
| JP | 03226590 A | * | 10/1991 |

OTHER PUBLICATIONS

Hanna et al., "Direct Electroplating on Printed Circuit Boards", Metal Finishing, vol. 99, Issue 4, Apr. 2001, pp. 51-54.*

Woods, "An Introduction to Boron: History, Sources, Uses, and Chemistry", Environmental Health Perspectives (Nov. 1994), vol. 102, Supplement 7, pp. 5-11.*

Djokic, "Electrodeposition of Amorphous Alloys Based on the Iron Group Metals", J. of the Electrochem. Soc. (no month, 1999), vol. 146, No. 5, pp. 1824-1828.*

A. Brenner, Electrodeposition of Alloys, vol. II, Academic Press, 1963, 457-483.

S. Djokic, J. Electrochemical Soc., 146(5), 1824-1828.

J. Herreros et al., Non-Crystalline Solids 201(1996), 102-109.

(Continued)

*Primary Examiner* — Edna Wong

(57) ABSTRACT

Cobalt-phosphorous-boron coated objects and processes for production of the same. The coatings are wear resistant and may have several characteristics that render them suitable for applications in certain industries, such as the aerospace industry. The manufacturing process for the coated objects is free of hexavalent chromium fumes generation. The process of manufacture includes the steps of at least partially submerging a metal object as a cathodic element into a plating bath. The plating bath includes an aqueous solution of cobalt ions, chloride ions, phosphate ions, phosphite ions and boron-containing ions. The plating bath may have a pH in the range from about 1.0 to about 1.8. Current flows between an anode in the plating bath and the cathodic element in contact with an object to be coated for a time sufficient to deposit a cobalt-phosphorous-boron coating on the object. The current continues to flow until a coating of desired thickness is obtained.

11 Claims, 2 Drawing Sheets

OTHER PUBLICATIONS

Aerospace Material Specification, AMS-QQ-C-320, Chromium Plating (Electrodeposited), Society of Automotive Engineers, Inc. (SAE), Warrendale, PA, USA, Jul. 2000.

Department of Defense Standard Practice, MIL-STD-1501D (USAF), Chromium Plating (Electrodeposited), Mar. 1, 2005.

* cited by examiner

PROCESS FOR PLATING A METAL OBJECT WITH A WEAR-RESISTANT COATING AND METHOD OF COATING

CROSS-REFERENCES TO RELATED APPLICATIONS

This is a continuation-in-part of U.S. patent application Ser. No. 10/772,683, filed Feb. 4, 2004, now abandoned.

TECHNICAL FIELD

The technology herein generally relates to wear resistant coatings and electroplating processes and, more particularly, to a cobalt-phosphorous-boron coating and to a cobalt-phosphorous-boron plating process.

BACKGROUND

Chromium plating has been used for many years to apply a wear resistant coating to ferrous and nickel alloys. Currently, chromium plating is used in the aerospace industry, among others, to apply a tough wear resistant coating on parts such as landing gear parts, pistons, pins, hooks, and other types of parts that are severely loaded, have sliding surfaces or could experience impact during service. Chromium plating is one of the most widely used processes to apply wear resistant coatings in the aerospace industry, and many plating shops perform this operation routinely. However, the EPA has issued limits on air pollution caused by chromium as well as tightened the limits for chromium in the water. Furthermore, the process for depositing the chromium is regarded as a potentially hazardous process. The plating solution generates large amounts of fumes during the chromium plating process that may go on for several hours. These fumes are considered toxic to the shop personnel since the fumes contain hexavalent chromium, which is a suspected carcinogen. Occupational worker regulations now require expensive emission controls, which include anti-mist chemicals, vent ducts, and fume scrubbers.

Furthermore, from an engineering standpoint, chromium plating falls short in several requirements. Micro-cracks in the coating allow for moisture ingress, which severely reduces corrosion resistance on, for example, alloy steel. These micro-cracks also reduce fatigue life, since they serve as initiation sites for cracks that will extend into the base metal. And finally, both high coating stresses and the solution's strong oxidizing environment leads to a high risk of poor coating adhesion.

The aerospace industry has implemented some replacement processes for chromium plating. These prior art processes include, for example, the application of high velocity oxygen fuel (HVOF) thermal spray coatings, composite electroplating, and electroless deposition. Even though HVOF thermal spray coatings meet or surpass the engineering properties of chromium plate, their application is limited to line-of-sight applications, i.e. 1:1 width-to-depth ratios, often called aspect ratios. Blind holes, for example, cannot be coated using this technology. The application of composite coatings, which incorporates hard particulates, requires costly facility modifications to keep the particles continuously in suspension during processing. Finally, bath stability issues and adhesion failures on critical hardware restrict the use of electroless coatings on commercial aircraft.

Furthermore, Integran Technology of Toronto, Canada, has developed a nanophase electroplating technology that uses pulse electroplating to deposit a cobalt alloy on a substrate.

This technology requires plating equipment that is different from the existing chromium plating equipment and, therefore, requires costly modifications of the existing facilities. Also, the area that can be plated using the nanophase technology is limited by the maximum-pulsed current capability of the power supply. Furthermore, high tensile residual stresses in the coating will cause an unacceptable debit in fatigue life.

Accordingly, it is desirable to develop a wear resistant coating for metals that meets the engineering requirements for aircraft and other wear resistant coatings and that can replace coatings that contain hexavalent chromium. Moreover there is a need for a coating not as susceptible to containing micro-cracks as chromium plating. In addition, there is a need to provide a process for plating that replaces the chromium plating process and that may use the existing facilities and equipment used to produce chromium coatings without producing hexavalent chromium fumes. Further, there is a need to provide a process that enables the plating of all desired surfaces including non line-of-sight applications, for example, blind holes. Other desirable features and characteristics of embodiments of coatings and processes will become apparent from the subsequent detailed description and the appended claims, taken in conjunction with the accompanying drawings and the foregoing technical field and background.

BRIEF SUMMARY

Embodiments include a metal object coated with a wear resistant cobalt-phosphorous-boron coating. The coating may have several characteristics that render it suitable for applications in certain industries. For example, it may meet the aerospace standards set forth elsewhere herein, and/or other applicable industry standards. The manufacturing process for the coated objects is free of the generation of hexavalent chromium fumes.

Embodiments of the process of manufacture include the steps of at least partially submerging a metal object as a cathodic element into a plating bath. The plating bath includes an aqueous solution of cobalt ions, chloride ions, phosphate ions, phosphate ions and boron-containing ions. The plating bath may have a pH in the range from about 0.0 to about 2.0. Current flows between an anode in the plating bath and the cathodic element which is in contact with the object to be coated for a time sufficient to deposit a cobalt-phosphorous-boron coating on the object. The current continues to flow until a coating of desired thickness is obtained.

BRIEF DESCRIPTION OF THE DRAWINGS

Various embodiments will hereinafter be described in conjunction with the following drawing figures, wherein like numerals denote like elements.

DETAILED DESCRIPTION

Figure 1:
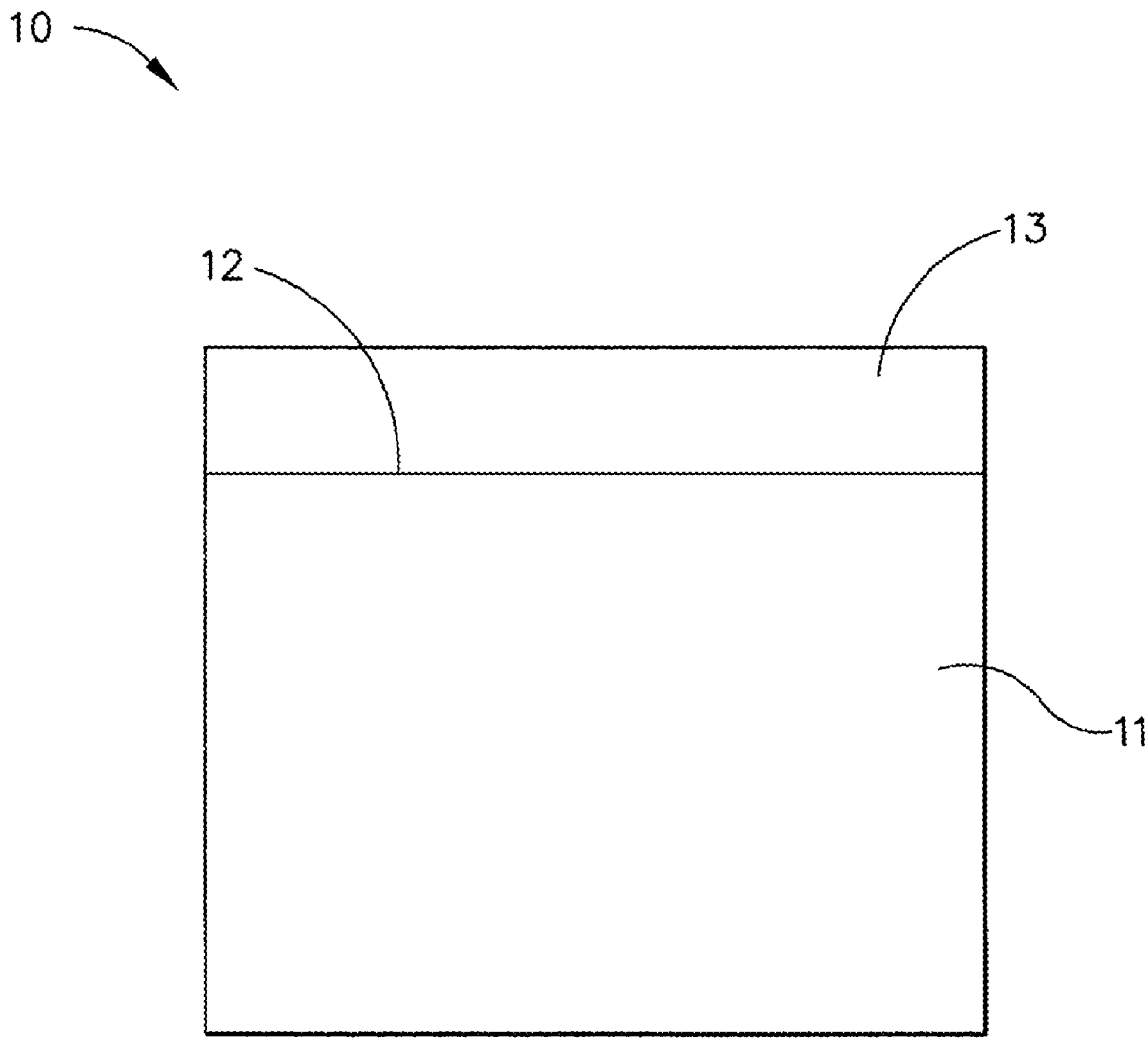
FIG. 1 is a schematic cross sectional view of an article of manufacture according to one embodiment.

The following detailed description is merely exemplary in nature and is not intended to limit the described embodiments or the application and uses of the described embodiments. Furthermore, there is no intention to be bound by any expressed or implied theory presented in the preceding technical field, background, brief summary or the following detailed description.

As explained above, there is a need for wear resistant coatings to replace chromium coatings, the production of which releases hexavalent chromium fumes into the surroundings. In order to meet these needs, the coatings should have low residual stress. Typically, as coatings become thicker, residual stresses increase. However, thicker coatings last longer than thinner coatings, all other factors being equal, under wear conditions, if the coatings have the same residual stresses. Accordingly, there is an expected limiting coating thickness beyond which the adverse effects of increase in residual stresses exceeds the potential gain expected from longer life under wear conditions. Embodiments provided herein enable the production of "thicker" coatings that are long lived under wear conditions and yet have low residual stresses. In one embodiment, the coating thickness may range from about 0.3 mils (thousandths of an inch) for a relatively thin coating, to about 2 to 3 mils; up to about 10 mils for thick coatings; and ranging from about 10 mils up to about 20 to about 30 mils or even up to about 50 mils or more for thicker coatings, while maintaining low residual stress levels. Some exemplary embodiments of the coatings meet specifications set forth in AMS-QQ-C-320 and MIL-STD-1501, both of which are hereby incorporated by reference as if fully set forth herein.

Coating hardness is a factor in providing wear resistance. Certain embodiments of the coatings presented here have a hardness measure in the range from about Vickers Hardness 595 to about Vickers Hardness 700. When the Knoop Hardness Index is used, some embodiments have a Knoop Hardness from about 630 to about 735.

While embodiments of the coatings may be used in a variety of applications, certain exemplary embodiments meet perhaps the most stringent coating standards, namely aerospace standards AMS-QQ-C-320 and MIL-STD-1501, which are both incorporated herein by reference as if fully set forth. Embodiments that are not intended for such demanding application as in aerospace may not meet all the specifications set forth in either of these standards. However, coatings used in aerospace applications should meet at least one of the standards. While reference will be made to the aerospace industry as an example throughout this disclosure, it should be appreciated that the coatings at issue may be used in a variety of industries.

Broadly, an embodiment provides a cobalt-phosphorous-boron coating that may be used to replace the chromium plate that is currently commonly used as a wear protective coating, for example in the aerospace industry. The cobalt-phosphorous-boron coating furthermore meets or exceeds the engineering properties of prior art chromium plate in many respects. For example, the coatings are free of micro-cracks as measured in Class I section 4.9 of MIL-STD-1501. This should result in far better resistance to fatigue and corrosion of the type initiated at micro-crack locations. Embodiments of the cobalt-phosphorous-boron coating meet aircraft standards and may be applied to aircraft parts that are severely loaded, have sliding surfaces, or could experience impact during service, such as landing gear parts, pistons, shafts, pins, and hooks.

An embodiment further provides a process for cobalt-phosphorous plating that may be used to replace the chromium plating process that is currently commonly used to apply chromium plate to a substrate, such as ferrous and nickel alloys. By providing a cobalt-phosphorous plating process for application of a cobalt-phosphorous-boron coating to various substrates, the use of chromium, which is a chemical that is limited in use by the EPA, can be eliminated. By eliminating chromium from the plating solution, as in one embodiment, fumes containing hexavalent chromium, a suspected carcinogen, will not be produced, in contrast to typical prior art processes using chromium. Furthermore, the cobalt-phosphorous plating process according to one embodiment does not require major facility modification that might be expensive. The cobalt-phosphorous plating process may use the same and already existing facilities and equipment that are used for the prior art chromium plating process.

In one embodiment, the cobalt-phosphorous-boron coating is bright, ductile, dense, and free of micro-cracks. Therefore, the coating exceeds the engineering properties of prior art chromium plate. The cobalt-phosphorous-boron coating further possesses sufficient hardness and low residual stress to meet wear and fatigue requirements, respectively, while also meeting or exceeding the engineering properties of prior art chromium plate. The increased ductility, substrate adhesion, and corrosion resistance of the cobalt-phosphorous-boron coating compared to the prior art chromium plate will extend the life of parts that need to be repaired or scrapped often, such as flap track carriage spindles.

An embodiment further provides a cobalt-phosphorous plating process that uses a plating solution having a simple composition. By combining cobalt sulfate, sodium chloride, boron, phosphite, and phosphate in the plating solution, no chemicals that are restricted in use by the EPA are used. Therefore, the cobalt-phosphorous plating process is an environmentally acceptable process. Further, contrary to the prior art chromium plating process, no fumes that are hazardous to the health of the shop personnel will be produced. Also, embodiments of the cobalt-phosphorous plating process may replace the prior art sulfamate nickel repair of damaged or corroded areas, eliminating a further chemical element restricted in use by the EPA. Furthermore, the cobalt-phosphorous plating process allows the application of the cobalt-phosphorous-boron coating, as in one embodiment, to all desired surfaces, including, for example, blind holes. Contrary to the prior art HVOF thermal spray coatings, cobalt-phosphorous-boron coatings are not limited to line-of-sight applications. A higher plating rate at a lower current density compared to prior art chromium plating is achievable with the cobalt-phosphorous plating process as in one embodiment. Therefore, the cobalt-phosphorous plating process is more efficient than the prior art chromium plating process.

In embodiments of a plating bath containing salts useful in producing a cobalt-phosphorous-boron coating that has wear resistance, the salt that provides chloride ions in the bath should be of a type that is highly soluble; a salt that ionizes readily in the bath taking into account all the other salts also present in the bath. Accordingly, sodium chloride and other Group I metal salts of chlorine that ionize readily in aqueous solutions are most useful. Other, less water-soluble chloride salts are also useful, such as the Group II metal salts. However, although use of less soluble salts are within the scope of the presently disclosed technology, the Group I metal salts of chlorine are inexpensive, commercially available, ionize readily in the concentrated salt baths, produce a good coating of reduced residual stress, and are therefore generally better to use. In addition, while chlorine salts that have large associated cations may be used, many of the embodiments of the salt baths contain readily ionizable chlorine salts with smaller associated cations, such as sodium or potassium cations. Sodium chloride is preferred to cobalt or ammonium chloride because the sodium cation is smaller and this results in less residual stress in the coating In some embodiments of the plating baths, the salt that provides the boron component of the coating produces perborate ions in the plating bath. Thus, the nature of the boron salt should be such that, in these embodiments, the boron salt ionizes readily to yield a useful concentration of perborate ions in the plating bath.

Figure 2:
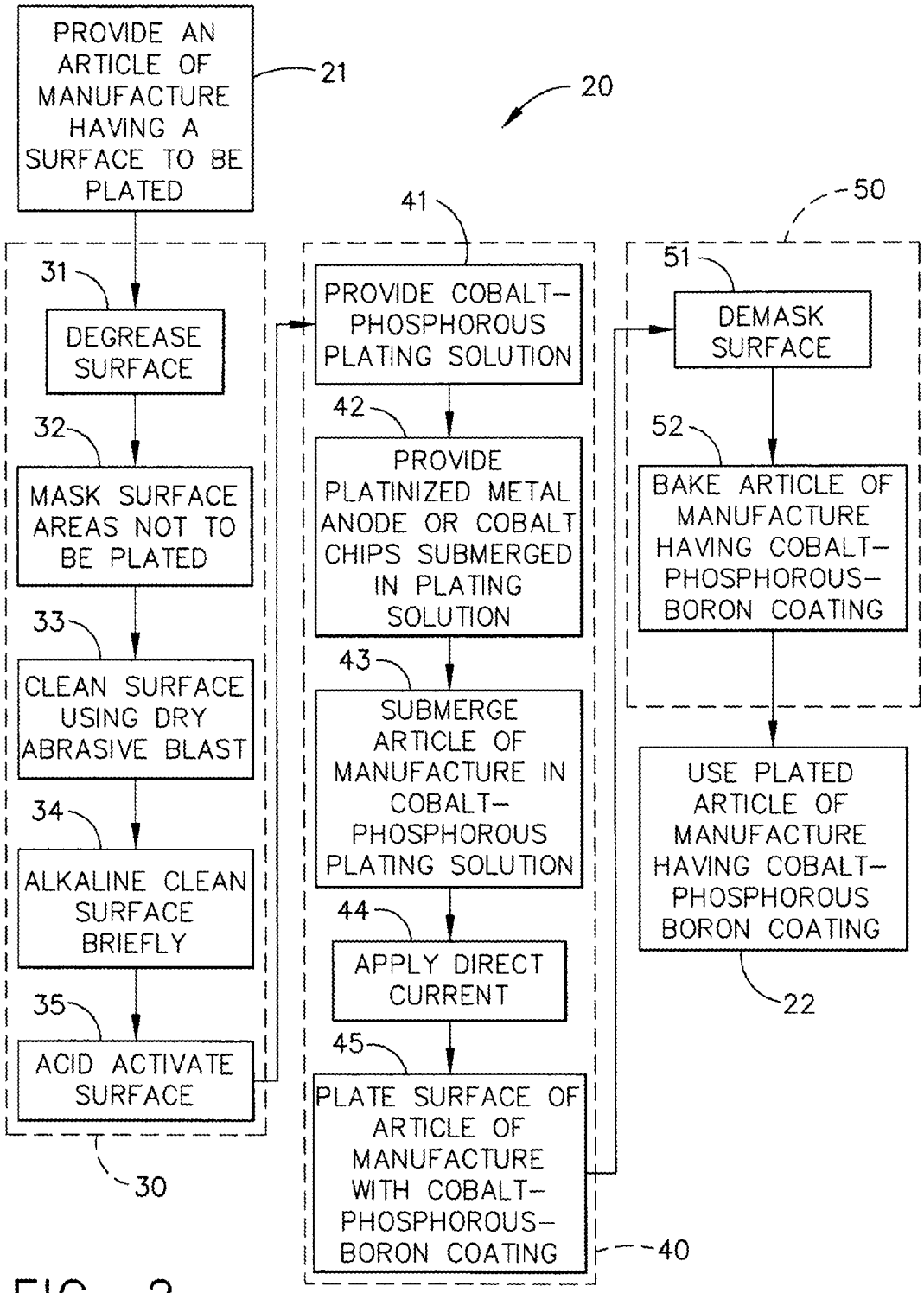
FIG. 2 is a flow chart of a process for plating according to one embodiment.

Referring now to FIG. 1, an article of manufacture 10 is illustrated in a schematic cross sectional view according to one embodiment. The article of manufacture 10 includes a substrate 11 having a surface 12 and a cobalt-phosphorous-boron coating 13. The cobalt-phosphorous-boron coating 13 may be applied to the surface 12 during a cobalt-phosphorous plating process 40, as shown in FIG. 2. The article of manufacture 10 may be a part of a commercial aircraft that is severely loaded, has sliding surfaces, or could experience impact during service, for example, a landing gear part, a piston, a shaft, a pin, and a hook. The article of manufacture 10 may be used, for example, in the aerospace industry.

The substrate 11 of the article of manufacture 10 may have a catalytically active surface. Suitable substrates 11 may be composed, for example, of nickel, cobalt, iron, steel, aluminum, zinc, palladium, platinum, copper, brass, chromium, tungsten, titanium, tin, silver carbon, graphite and alloys thereof. Typical substrates for the application of the cobalt-phosphorous-boron coating 13 include ferrous and nickel base alloys.

Referring now to FIG. 2, a process for plating 20 is illustrated in a simplified flow chart according to one embodiment. The process for plating 20 may include a step 21, a pretreatment process 30, a cobalt-phosphorous plating process 40, a post treatment process 50, and a step 22. The article of manufacture 10 having a surface 12 to be plated with a wear resistant coating 13 may be provided in step 21. During the pretreatment process 30, the surface 12 of the article of manufacture 10 provided in step 21 may be cleaned and prepared for the cobalt-phosphorous plating process 40. During the cobalt-phosphorous plating process 40 the surface 12 of the article of manufacture 10 provided in step 21 may be plated with a cobalt-phosphorous-boron coating 13. The cobalt-phosphorous-boron coating 13 meets the engineering requirements for aircraft wear coatings. During the post treatment process 50, the plated article of manufacture 10 will be prepared for its application in the industry by finishing the cobalt-phosphorous-boron coating 13. Finally, in step 22, the plated article of manufacture 10 may be built into, for example, a commercial aircraft.

The pretreatment process 30 may include steps 31, 32, 33, 34, and 35. In step 31, the surface 12 of the article of manufacture 10 provided in step 21 may be degreased. The degreasing of the surface 12 may be done, for example, by vapor degrease, solvent wipe, or aqueous degrease. The solvent wipe, where the surface 12 may be wiped with solvents such as ketones, alcohols or similar solvents, may be used preferably for smaller articles of manufacture 10. An aqueous degreaser may be used to degrease the surface 12 of larger articles of manufacture 10. The aqueous degreaser may be applied to the surface 12 in step 31 either by spraying onto the surface 12 or by immersion of the surface 12 into the aqueous degreaser.

Surface areas of the surface 12 that should not receive a wear resistant coating may be masked in step 32. For example, lacquers, rubber-based coatings, and tapes composed of vinyl, Teflon or lead are typical materials that may be used to mask surface areas of the surface 12 in step 32. If the configuration of the article of manufacture 10 allows, rubber boots may also be used in step 32 to mask areas of the surface 12 that should not be coated. After application of a mask in step 32, the surface 12 of the article of manufacture 10 may be cleaned in step 33 using a dry abrasive blast. An abrasive material such as glass bead or aluminum oxide having a grit size in the range of about 80 to 220 may be blasted onto the surface 12 at about 60 psi in step 33, for example. In step 34, a brief alkaline cleaning may follow the dry abrasive blast cleaning of step 33 to ensure a thoroughly cleaned surface 12. The cleaning process of step 34 may be an electrolytic process requiring the use of a rectifier as a power supply. The article of manufacture 10 may be immersed in an alkaline electrolyte solution and may be hooked as cathode. Furthermore inert anodes may be used. Once the circuit is closed a cathodic (plating) cycle may be started. The cathodic cycle may alternate with an anodic (de-plating) cycle for about 5 to 10 minutes ending with the anodic cycle. Following the cleaning of the surface 12 in steps 31, 32, 33, and 34, the surface 12 of the article of manufacture 10 provided in step 21 might be acid activated in step 35. During step 35 the surface 12 may be immersed in an immersion solution for about 5 to 60 seconds. The process flow, as in steps 31, 32, 33, 24, and 35 of the pretreatment process 30 illustrated in FIG. 2, may be just one of many possible routes. The process flow of the pretreatment process 30 may be adjusted dependent on the material of the substrate 11, for example, low and high strength alloy steels, copper alloys, aluminum alloys, and nickel base alloys, as well as the heat treat of the substrate 11. The steps 31, 32, 33, 34, and 35 of the pretreatment process may be comparable to the pretreatment steps of a prior art chromium plating process. Therefore, existing facilities and equipment may be used for steps 31, 32, 33, 34, and 35 keeping the costs of implementing the process of plating 20 relatively low.

The cobalt-phosphorous plating process 40 may include the steps 41, 42, 43, 44, and 45. A cobalt-phosphorous plating solution may be provided in step 41 for the cobalt-phosphorous plating process 40. The cobalt-phosphorous plating solution may be provided as a plating bath in relatively large tanks. The cobalt-phosphorous plating solution may include the following components: cobalt metal ions, chloride ions, phosphorous ions, an oxidizing agent, and a hardening agent. The cobalt-phosphorous plating solution may have the following composition: cobalt sulfate as $CoSO_4.6H_2O$ in a range of from about 20 to about 26 oz/gal; sodium chloride as NaCl in a range of from about 2 to about 3.5 oz/gal; boron as perborate in a range of from about 1.6 to about 2.6 oz/gal; phosphite as phosphorous acid ($H_3PO_3$) in a range of from about 1.6 to about 2.6 oz/gal, and phosphate as phosphoric acid ($H_3PO_4$) in a range of from about 7 to about 9 oz/gal. The typical range for the cobalt metal content of the cobalt-phosphorous plating solution is from about 4.4 to about 5.8 oz/gal. While these ranges are typical, it should be understood that embodiments of plating baths may have one or more salt concentrations outside of these typical ranges and that such deviation from typical is within the scope of the presently disclosed technology. The surface tension of the cobalt-phosphorous plating solution having above described composition may be in a range of from about 20 to about 80 dyne/cm, and may often be in the range from about 35 to about 50 dyne/cm.

The typical range for the pH value of the cobalt-phosphorous plating solution is from about 1 to about 1.6, but a broader range from about 0.0 to about 2.0 may be useful.

The temperature of the cobalt-phosphorous plating solution may usefully be from about 100° F. to about 170° F., and a range of about 110° F. to about 120° F. may be more typical.

Cobalt sulfate may be a source for the cobalt metal ions in the cobalt-phosphorous plating solution, although other cobalt salts such as (but not limited to) citrate, phosphate, carbonate, and chloride may be used. Cobalt chips or balls submerged in the cobalt-phosphorous plating solution may also be used as a source for the cobalt metal ions.

Sodium chloride provides needed conductivity in the cobalt-phosphorous plating solution and may help to maintain the low compressive residual stress of the wear resistant coating that may be applied to the surface 12 of the article of manufacture 10 in step 45. Other chloride sources such as cobalt chloride and ammonium chloride may be used, but these may cause an unacceptable level of tensile residual stress in the coating.

Boron as added to the cobalt-phosphorous plating solution may act as a low pH buffer that allows for a high deposit quality over a wider plating range. Boron may further act as a catalyst that improves the bright deposition range by producing fine-grained deposits over a wider range of process variables such as current density and temperature. In general, it is recommended that the boron-containing chemical that may be added to the cobalt-phosphorous plating solution to provide boron is such as to provide perborate ions in the plating bath. However, boric acid or other borate compounds may also be used.

Phosphite may be added to the cobalt-phosphorous plating solution as a hardening agent that provides a certain hardness of the wear resistant coating that may be applied to the surface 12 of the article of manufacture 10 in step 45. Instead of phosphorous acid to provide phosphite, other sources of phosphite such as sodium phosphite or sodium hypophosphite might be used as a hardening agent. Phosphate may be added to the cobalt-phosphorous plating solution to provide the conductivity of the plating solution, to provide for phosphate/phosphite equilibrium, and to maintain the pH value of the plating solution within a certain range. Instead of phosphoric acid to provide phosphate, cobalt phosphate or sodium phosphate might be used.

The cobalt-phosphorous plating solution may be designed to be used in large volumes for long time periods without the need for frequent tank dumps or draw offs to maintain the bath chemistry within limits. Since cobalt metal ions and phosphorous ions may deplete in a constant ratio during the plating process of step 35, only minor additions and solution draw offs may be necessary for long-term maintenance. In some circumstances, stress reducers based on sulfur compounds such as sodium saccharin may be added to increase the hardness and increase the compressive stress.

In step 42, an anode may be provided for the cobalt-phosphorous plating process 40. The anode may be a platinized metal anode submerged in the cobalt-phosphorous plating solution that may be provided in step 41. The anode provided in step 42 may further consist of cobalt chips or balls. The cobalt chips or balls may be placed in a basket and then submerged in the cobalt-phosphorous plating solution. If cobalt chips or balls are used as an anode in the cobalt-phosphorous plating process 40 instead of the platinized metal anode, it might not be necessary to add cobalt sulfate or other cobalt salt to the cobalt-phosphorous plating solution as described in step 41. The cobalt chips or balls will dissolve slowly in the cobalt-phosphorous plating solution and provide cobalt metal ions to the plating solution.

After providing the cobalt-phosphorous plating solution in step 41 and the anode in step 42, the article of manufacture 10 provided in step 21 may be submerged in the cobalt-phosphorous plating solution in step 43, as shown in FIG. 2. Now a direct current may be applied between the cathode and the anode in step 44. The article of manufacture 10 provided in step 21 may act as the cathode having a cathode current density. The direct current may typically be chosen to generate a cathode current density in a range of about 60 Amps/ft$^2$ to about 288 Amps/ft$^2$. It may be possible to apply a pulse current to the plating solution instead of using direct current.

With the application of a direct current in step 44, the plating of the surface 12 of the article of manufacture 10 submerged in the cobalt-phosphorous plating solution may be started. In step 45, the surface 12 may be plated with a cobalt-phosphorous-boron coating 13. The cobalt-phosphorous-boron coating 13 may be a wear resistant coating having the following composition: cobalt with a preferred range of 80 to 90 weight percent; phosphorous with a preferred range of 10 to 15 weight percent; and boron with a maximum of 5 weight percent. The cobalt-phosphorous-boron coating 13 may be deposited on all surfaces 12 of the article of manufacture 10 submerged in the cobalt-phosphorous plating solution including non line-of-sight areas, such as blind holes. The thickness of the cobalt-phosphorous-boron coating 13 applied to the surface 12 in step 45 may be adjusted depending on the time period over which the direct current is applied. The cobalt-phosphorous-boron coating 13 may be deposited on the surface at a plating rate of about 0.001 inch/hr to about 0.005 inch/hr. Therefore, the cobalt-phosphorous plating process 40, as shown in FIG. 2, may have a faster plating rate compared to the plating rate of the prior art chromium plating process, which is about 0.0005 inch/hr at 140 F. By using the cobalt-phosphorous plating process 40, a cobalt-phosphorous-boron coating 13 may be obtained in step 45 that is ductile, free of cracks, and possesses sufficient hardness and compressive residual stress properties to meet wear and fatigue requirements for aircraft wear coatings. Further, the cobalt-phosphorous-boron coating 13 may have an improved corrosion resistance compared with prior art chromium plate. The composition of the cobalt-phosphorous plating solution provided in step 41 may provide an improved surface adhesion of the cobalt-phosphorous-boron coating 13 compared to prior art chromium plating.

The post treatment process 50 may include the steps 51 and 52, as shown in FIG. 2. After the cobalt-phosphorous-boron coating 13 was applied to the surface 12 of the article of manufacture 10 in step 45, the mask may be removed from the surface 12 in step 51. The tape applied to surface areas of the surface 12 in step 32 may be peeled off in step 51. Furthermore, if a rubber boot was used to cover areas of the surface 12 in step 32 it may be taken off in step 51. After additional rinsing that may be required to remove any residual chemical trapped underneath the masking composition, the article of manufacture 10 may be ready to be baked in step 52. The baking in step 52 may be performed in an oven at a temperature in the preferred range of about 375° F.+/−25° F., although this can vary due to substrate heat treatment. The duration of the baking may vary from about 3 hours to about 23 hours depending on the strength level of the substrate 11, regardless of the thickness of the cobalt-phosphorous-boron coating 13. The baking in step 52 shall follow, within 8 hours, the step 45 where the coating 13 is applied to the surface 12. The article of manufacture 10 may now be ready for application in the industry without any additional grinding or polishing. In other cases, the cobalt-phosphorous-boron coating 13 may require additional grinding or polishing to proper thickness (i.e. grinding to size) prior to its industry application. The post treatment process 50 may be comparable to the post treatment process of the prior art chromium plating process. Therefore, the already existing equipment and facilities may be used for the post treatment process 50. The article of manufacture 10 having a cobalt-phosphorous-boron plated surface 12 may now be ready for use in, for example, a commercial aircraft, as shown in step 22.

By providing a cobalt-phosphorous-boron coating 13 that may be applied to a surface 12 of an article of manufacture 10 (as in step 45) using the cobalt-phosphorous plating process 40, the prior art chromium plating solution may be eliminated improving the safety of the shop personnel by reduction of toxic fumes. Furthermore, by eliminating chemicals which use is restricted by the EPA, such as chromium, from the wear resistant coating as well as the plating process 20, an environmentally friendly wear resistant coating, the cobalt-phosphorous-boron coating 13, applied to a surface 12 in an environmentally friendly plating process 20 may be provided. By providing the cobalt-phosphorous plating process 40 that has a faster plating rate than the prior art chromium plating process, the operation flow time may be reduced. Also, by providing a cobalt-phosphorous-boron coating 13 having improved engineering properties compared to the prior art chromium plate and by providing a process for plating 20 that may use the already existing equipment and facilities of the chromium plating process, the cobalt-phosphorous-boron coating 13 may economically replace the prior art chromium plate.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. A process comprising:

at least partially submerging a metal object in a plating solution in a plating bath, the plating solution including a mixture of ions produced by cobalt sulfate, sodium chloride, perborate, and phosphorous acid, and flowing an electrical current in the plating solution to electrolytically deposit a cobalt-phosphorous-boron coating on the object.

2. The process of claim 1, wherein the plating bath is at a temperature in the range from about 100 to about 170° F.

3. The process of claim 1, wherein the flowing of an electrical current includes generating a cathode current density in a range of about 60 Amps/ft$^2$ to about 288 Amps/ft$^2$.

4. The process of claim 1, wherein the current continues to flow until the cobalt-phosphorous-boron coating has a thickness to about 0.050 inches.

5. The process of claim 1, wherein the plating solution has a pH in the range from about 0.0 to about 2.0, and consists essentially of a mixture of ions produced by dissolving in water the cobalt sulfate in a range of about 20 to about 26 oz/gal, the sodium chloride in a range of about 2 to about 3.5 oz/gal, the perborate in a range of about 1.6 to about 2.6 oz/gal, phosphoric acid in a range of about 7 to about 9 oz/gal, and the phosphorous acid in a range about 1.6 to about 2.6 oz/gal.

6. The process of claim 1, wherein the plating solution has a pH in the range from about 1.0 to about 1.8.

7. The process of claim 1, wherein the object is an aerospace object and the coating is a wear resistant coating on an outer surface of the aerospace object.

8. The process of claim 1, wherein the coating has a thickness in the range from about 0.010 to about 0.050 inches.

9. The process of claim 1, wherein the coating has a thickness in the range from about 0.030 to about 0.050 inches.

10. The process of claim 1, wherein the coating has a thickness of at least 0.050 inches.

11. The process of claim 1, wherein the combination of the sodium chloride and the perborate reduces residual stress in the coating and increases hardness and corrosion resistance of the coating.

* * * * *